US005836510A

United States Patent [19]

Kirchner

[11] Patent Number: 5,836,510

[45] **Date of Patent: *Nov. 17, 1998**

[54] LOCKING REMOVABLE BILL STACKING CASSETTE WITH MOVING RAILS

[76] Inventor: Roger Kirchner, 205 Oneota Rd., Highland Lakes, N.J. 07422

[ * ] Notice: This patent issued on a continued prosecution application filed under 37 CFR 1.53(d), and is subject to the twenty year patent term provisions of 35 U.S.C. 154(a)(2).

[21] Appl. No.: 523,408

[22] Filed: Sep. 5, 1995

[51] Int. Cl.[6] ..... G07B 15/00

[52] U.S. Cl. ..... 232/15; 194/206; 109/66

[58] Field of Search ..... 232/1 D, 15, 16; 109/45, 46, 66; 194/350, 206

[56] References Cited

U.S. PATENT DOCUMENTS

| | | | |
|---|---|---|---|
| 4,434,931 | 3/1984 | Hunt et al. | 232/15 |
| 4,438,704 | 3/1984 | Hutcheon . | |
| 4,447,097 | 5/1984 | Lafevers et al. . | |
| 4,720,092 | 1/1988 | Juleff . | |
| 4,834,230 | 5/1989 | Kondo et al. . | |
| 4,854,247 | 8/1989 | Sciortino et al. . | |
| 4,949,901 | 8/1990 | Harris . | |
| 4,997,128 | 3/1991 | Suris . | |
| 5,129,330 | 7/1992 | McKay et al. . | |
| 5,161,736 | 11/1992 | Roccoberton et al. . | |
| 5,205,481 | 4/1993 | Dekker . | |
| 5,209,335 | 5/1993 | Shuren et al. . | |
| 5,209,395 | 5/1993 | Zouzoulas et al. . | |
| 5,533,605 | 7/1996 | Mays et al. | 232/15 X |

*Primary Examiner*—Blair Johnson
*Attorney, Agent, or Firm*—White & Case; Jeffrey J. Oelke

[57] ABSTRACT

A locking removable bill stacking cassette is disclosed. The cassette is used in conjunction with a plunger-type currency validator which introduces bills into the cassette housing where they are stacked. The cassette includes a slideplate which is used to cover the plunger or open end of the cassette housing before detaching the cassette from the validator. Within the cassette are movable rails which provide a path for the slideplate and also move when the slideplate is inserted to provide an offset between the slideplate and the bill stack.

10 Claims, 8 Drawing Sheets

LOCKING REMOVABLE BILL STACKING CASSETTE WITH MOVING RAILS

FIELD OF THE INVENTION

The invention relates to an improved locking, removable bill stacking cassette which is used to store bills or similar items for connection to a currency validator in a vending machine, change machine or any other bill-accepting machine. More particularly, the cassette of the present invention is used in conjunction with a plunger-type validator which pushes validated bills into the housing of the cassette through an open end of the housing. The cassette also employs a slideplate in conjunction with moving slide rails, allowing easy insertion of the slideplate into the open end of the cassette housing to detach the cassette from the currency validator. Once the cassette is detached from the validator, it is a self-contained, secure unit that can be easily transported to a central location.

BACKGROUND OF THE INVENTION

Detachable bill stacking cassettes are commonly used for the storage and transport of bills or similar items from machines employing currency validators. They are generally employed with a currency validator outfitted with a plunger. The plunger acts to push a newly-validated bill into the cassette. A number of recurring problems have arisen in relation to bill stacker cassettes, principally 1) adaptability to various existing currency validators; 2) reliability of operation in conjunction with currency validators; 3) simplicity and ease of maintenance and removal from currency validators; 4) security provided in limiting access to the bills contained within the cassettes; and 5) cost.

Early examples of bill stacking cassettes did not provide for the security of the cassettes once they were detached from their currency validators. It was recognized that service personnel should not transport cassettes filled with bills which were easily accessible both to the service agent and to those who came into contact with the service agent while enroute. It thus was desirable to provide a cassette which, once removed from the validator, insured that the bills were inaccessible to the service personnel and only accessible at a central, secure location. U.S. Pat. No. 4,834,230 is directed to a combination of a currency validator and bill stacking cassette which employs a locking covering plate. However, this patent's invention would require either modification to an existing currency validator or simply would not be adaptable to existing validators. Because adaptability to existing currency validators is critical to the commercial acceptability of bill stacking cassettes, this invention was of limited applicability.

U.S. Pat. No. 5,129,330 discloses the removal of a bill stacking cassette through the use of a "security box cover" which enclosed the bill stacker cassette on all sides. Such a cassette requires bulk in addition to the necessary size for the bill stacking cassette. Because the room available for bill stacking cassettes inside various machines, such as bill changing machines, vending machines, casino games, etc. is often limited, the bulk of the security box cover is undesirable. Further, transport of the bulky security box covers, with or without the cassettes inside, would be undesirable.

U.S. Pat. No. 5,209,395 discloses a bill stacking cassette which employs a housing attached to the top of the cassette. The housing contains a locking mechanism which locks a pushing plate into place before the cassette may be removed from the validator. The cassette can then only be accessed through a hinged door in the bottom of the cassette. This cassette required the added bulk and expense of the housing/locking mechanism. Further, the pushing plate often would not engage because of contact with folded, bowed or otherwise protruding bills.

U.S. Pat. No. 5,161,736 discloses a bill stacking cassette with a slideplate which covers the side of the cassette through which the plunger pushes the bills. Service personnel carry the slideplates to the locations of the currency validators. The slideplate covers the exposed side of the cassette and once it is fully engaged, the cassette may then be removed from the validator. However, the slideplate of this invention would often not operate properly because bills which were folded, bowed or otherwise protruding obstructed the slideplate's path.

As is demonstrated by the preceding discussion, a need clearly exists for a portable, lockable bill stacking cassette which is easily adapted to various currency validators, is simple and reliable to operate, and is durable and secure and relatively inexpensive.

SUMMARY OF THE INVENTION

The apparatus of the present invention provides a lockable, removable bill stacking cassette which is universal, i.e., easily adaptable to a wide variety of currency validators which are equipped with a plunger mechanism for pushing bills into the cassette. The apparatus is adaptable, to but not limited to, currency validators made by Rowe, Mars and Dixie Narco. The apparatus is further reliable in operation and is easily removed from and attached to the currency validator. The apparatus also is secure in that it limits access to the stack of bills via the use of a locking mechanism which secures the stack of bills within the cassette such that the cassette may not be opened until desired, generally in a secure location such as a central office.

The apparatus has a locking mechanism which allows the service agent to detach the cassette from the validator when retrieving the cassettes in order to collect the bills stacked inside the cassette. The locking mechanism ensures that no one but the service agent is able to detach the cassette from the validator and have access to the bills stacked in the cassette. i.e., the only way to detach the cassette from the validator is with the key which unlocks the cassette from its attached or "loaded" position on the validator.

The apparatus is also equipped with a slideplate which is inserted to cover the bill stack at the plunger side of the cassette, i.e., the side through which the plunger pushes the bills from the validator into the cassette. The slideplate is inserted on a path which is created by slideplate rails which are situated near the plunger side of the cassette. The slideplate must be in a fully inserted position before the locking mechanism may be unlocked and the cassette removed from the validator.

In a preferred embodiment, the apparatus may also be outfitted with a second locking mechanism which ensures the further security of the cassette. The second locking mechanism operates such that the slideplate is locked into place when it is fully inserted to cover the cassette and cannot be removed until the second locking mechanism is unlocked. The second locking mechanism operates such that the first locking mechanism may be unlocked at the validator and the second locking mechanism unlocked at a secure location. The dual locking mechanisms allows the service agent to retrieve the cassette without access to the bills which are secure inside the cassette. This insures that the collector is not able to help himself to the bills inside the cassette and also that anyone whom the service agent encounters does not have access to the bills inside the cassette.

It is further preferred that both the first and second locking mechanisms are key-operated. Pursuant to such an embodiment, the service agent carries the key to the first locking mechanism where he unlocks the first locking mechanism and then fully inserts the slideplate, which allows him to detach the cassette from the validator. He is then able to transport the cassette to a central, secure location where a clerk who has the authority to handle the bills uses a second key to unlock the second locking mechanism which allows the clerk to slide the slideplate out of the slide path and thus give him access to the stack of bills within the cassette.

The apparatus of the invention is further equipped with movable rails which provide a path for the slideplate upon its insertion. The movable rails operate so that the last bill which the plunger pushes into the chamber of the cassette rests on top of the bill stack but below the bottom of the rails. The movable rails operate such that when the slideplate first contacts the rails, the rails drop down from their original standby position to a second position where the rails are farther from the plunger side of the cassette, thus providing an offset between the slideplate and the bill stack. The preferred mechanism which operates to allow the movable rails to move when the slideplate is inserted is a flipper, which is attached to the front end of the movable rails. The movable rails themselves are mounted onto two sliding pins which provide two positions, one for the standby or first position and one for the offset or second position. The flipper is mounted so that the slideplate first contacts the flipper which is flipped down so that it rests between the slideplate and the movable rails. The operation of the movable rails thus makes it possible for an offset to result between the slideplate and the movable rails which decreases dramatically the chances of a creased or bowed or otherwise improperly-oriented bill to obstruct the slideplate path and prevent the slideplate from being fully inserted.

Thus, a locking, removable cassette with moving rails in accordance with this invention allows easy operation and maintenance, is adaptable to many different currency validators, is secure in that it limits access to the bill stack, is relatively inexpensive, yet allows for easy, consistent and dependable removal of the cassette from the validator.

DESCRIPTION OF THE DRAWINGS

FIG. 4*a* shows the moving rails in the standby or first position, while FIG. 4*b* shows the moving rails in the offset or second position.

FIG. 5*a* shows the moving rails in the standby or first position while FIG. 5*b* shows the moving rails in the offset or second position.

DETAILED DESCRIPTION

Figure 1:
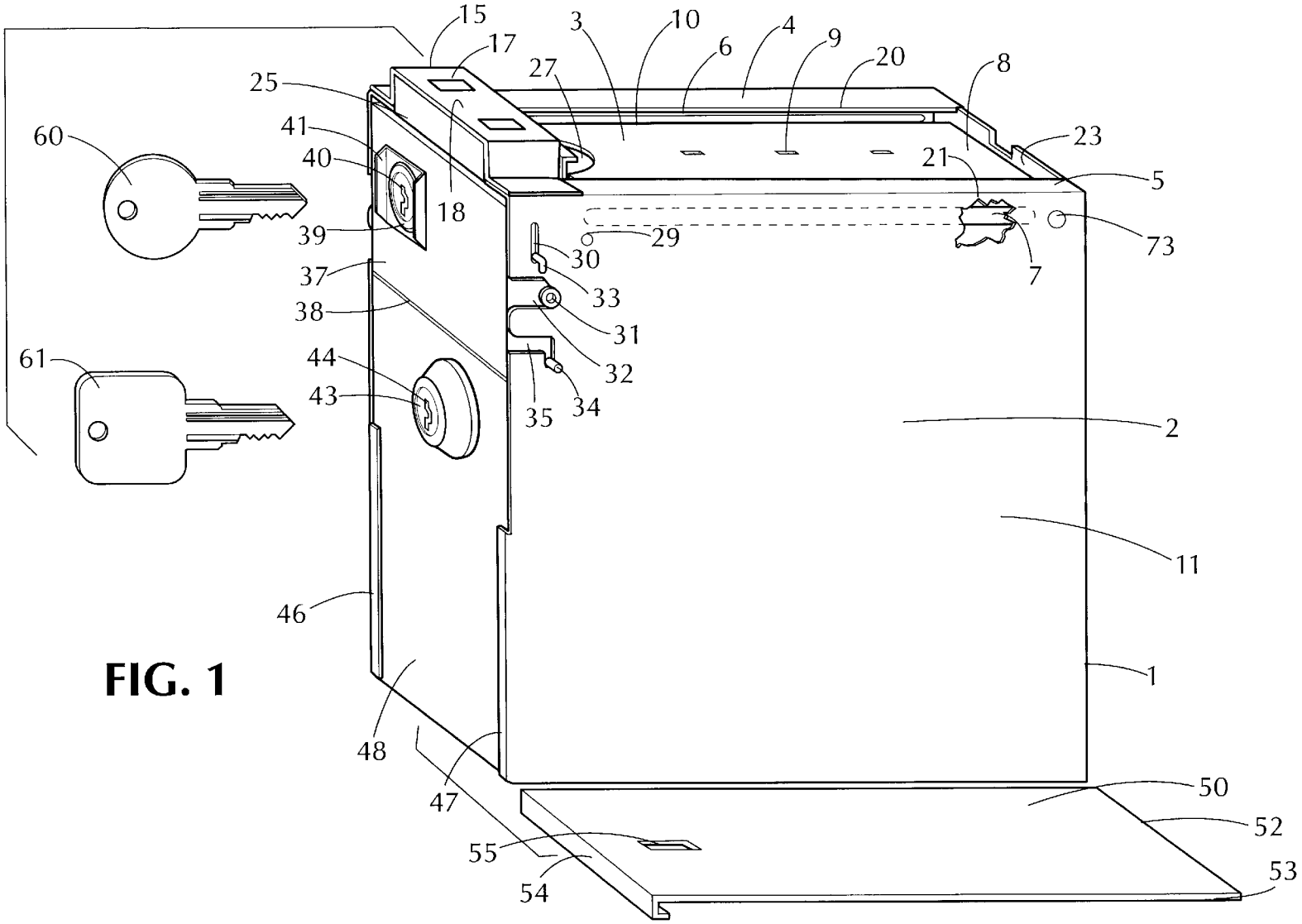
FIG. 1 illustrates a locking, removable bill stacking cassette's side, front and top.

FIG. 1 shows a locking, removable cassette 1 for the storage of stacked bills for connection to a plunger-type currency validator which includes side, top and front portions of the cassette. The embodiment illustrated in FIG. 1 includes a rectangular housing 11 which can hold up to 1000 stacked bills in its chamber 2. The dimensions of the cassette can vary depending on the number of bills desired to be stored. The width and length of the cassette must be adequate such that it is somewhat wider and longer than a flat dollar bill or whatever currency is to be stored in the cassette. The top side or plunger side of the cassette contains an opening 3 which is defined by the two thin outer plates 4 and 5 which run the length of the plunger side of the cassette. The opening 3 provides access to the cassette chamber 2 for the plunger of the currency validator. The validator and cassette work in conjunction so that when the validator accepts a bill, it is oriented such that it is flat and parallel to the plunger side, with the bill's length and width corresponding with the housing 11's length and width. Once the bill is oriented, the validator's plunger activates, pushing the bill into the cassette chamber 2 such that the bill rests just below moving rails 6 and 7 in a lengthwise slot 10 which sit below outer plates 4 and 5. As each is pushed by the plunger into the cassette chamber 2 to a point where the bill rests just below the moving rails 6 and 7, the bill comes to rest on top of the previous bill. With succeeding bills, a bill stack is thus created within the chamber 2. The bottom or first bill pushed into the cassette by the validator plunger sits on top of an underplate 8 which is of a slightly smaller width and length than the cassette housing 11 such that the underplate 8 fits inside the cassette and may move up and down with the bill stack, but such that the underplate 8 is always roughly parallel to the plunger side of the cassette housing 11 defined by the outer plates 4 and 5. The mechanism which moves the underplate 8 up and down is shown below in FIG. 3. The underplate 8 may be equipped with lengthwise cavities 9.

Also shown on the top or plunger side of the cassette housing 11 is a validator coupling 15 which sits on the top side of the cassette with coupling apertures 17 and 18. The validator coupling 15 houses an attaching mechanism [unseen] which provides a means for attaching and detaching from the validator.

Running parallel to the plunger side surface is slidepaths 20 and 21 which are defined by the space between the outer plates 4 and 5 and the moving rails 6 and 7. The slidepaths provide the path for the slideplate 50, which is equipped with a slot 55. Slideplate 50 is slightly narrower than the width of the cassette housing 11 to facilitate its sliding into the space provided between the slidepaths 20 and 21. The slideplate may be slid into place in the following manner: the slideplate's leading edge 52 is inserted into a slot 25 and then the slideplate 50 is slid parallel to the plunger side of the cassette until it contacts a flipper 27. The flipper 27 is flipped down from its standby or first position to its offset or second position. As shown in reference to FIGS. 4*a*, 4*b*, 5*a*, and 5*b*, the moving rails are then also moved from their standby or first position to their offset or second position. After contacting the flipper with the leading edge 52, the slideplate slides through the slidepaths 20 and 21 until the slideplate 50 is fully inserted and the leading edge 52 comes into contact with the inner portion of the back wall 23 of the cassette. At this point, the slideplate 50 is in the loaded position.

Dispatched on the front side of the cassette in a front wall 48 and below a removable hatch 37 is a first key lock 43 with keyhole 44. Extending vertically along a portion of the front wall 48 from the bottom of the front wall 48 are outer plates 46 and 47.

Dispatched on the front, upper side of the cassette is a removable hatch 37 which is disposed with a second key lock 39. The second key lock 39 contains a keyhole 40 and is protected from damage by protective mounting 41. The hatch 37 is equipped with a latchpin 33 which operates so that when the second key lock 39 is in the locked position, the latchpin 33 is disposed outside a latchpin slot 30. When the second key lock 39 is in an unlocked position, the latchpin 33 retracts inside the latchpin slot 30. Also disposed with the hatch 37 is a first pin 31 which is disposed in a first pin slot 32 and a second pin 34 which is disposed in a second pin slot 35. The pins 31 and 34 aid in the smooth removal and replacing of the hatch 37. The cassette housing is also outfitted with a holding pin 73 which, when the cassette is in operation with the validator, aids in holding the cassette in place.

The first key lock 43, the second key lock 39, the attaching mechanism in the housing of the validator coupling 15 and the slideplate 50 work together to provide the locking and unlocking mechanisms by which the cassette is detached from the validator and carried to a secure location where it is then opened. The sequence of operational steps works in the following manner: an unloaded cassette, i.e. a cassette in which the slideplate is not inserted and the first key lock 43 and the second key lock 39 are both in the locked position, is taken by a service agent to a remote location for attachment to a currency validator. When the service agent arrives at the remote location, he places the cassette into its designated position in conjunction with the currency validator. Because the slideplate is not in position and the first and second key locks are both in the locked position, the cassette is ready to attach to the currency validator and will attach to the prongs [not shown] of the currency validator through the coupling apertures 17 and 18. At a later time, the service agent returns to collect the cassette which will now contain all the bills which have been pushed into it by the plunger of the currency validator since the cassette was attached. The service agent will return with a key 61 which operates the first key lock 43 and slideplate 50. The service agent unlocks the first key lock 43 with key 61 and then inserts the slideplate 50 into the fully inserted or loaded position. The cassette will then freely detach from the currency validator. After the cassette is brought to a central, secure location, a clerk with key 60 may unlock second key lock 39, which will swing the linchpin 33 inside the linchpin slot 30, which will allow the hatch to be removed. Once the hatch it removed, the clerk will have access to the stacked bills inside. Once the bills are removed, the hatch is restored, and the second key lock 39 is locked, the cassette is ready to be attached to a currency validator again.

Figure 2:
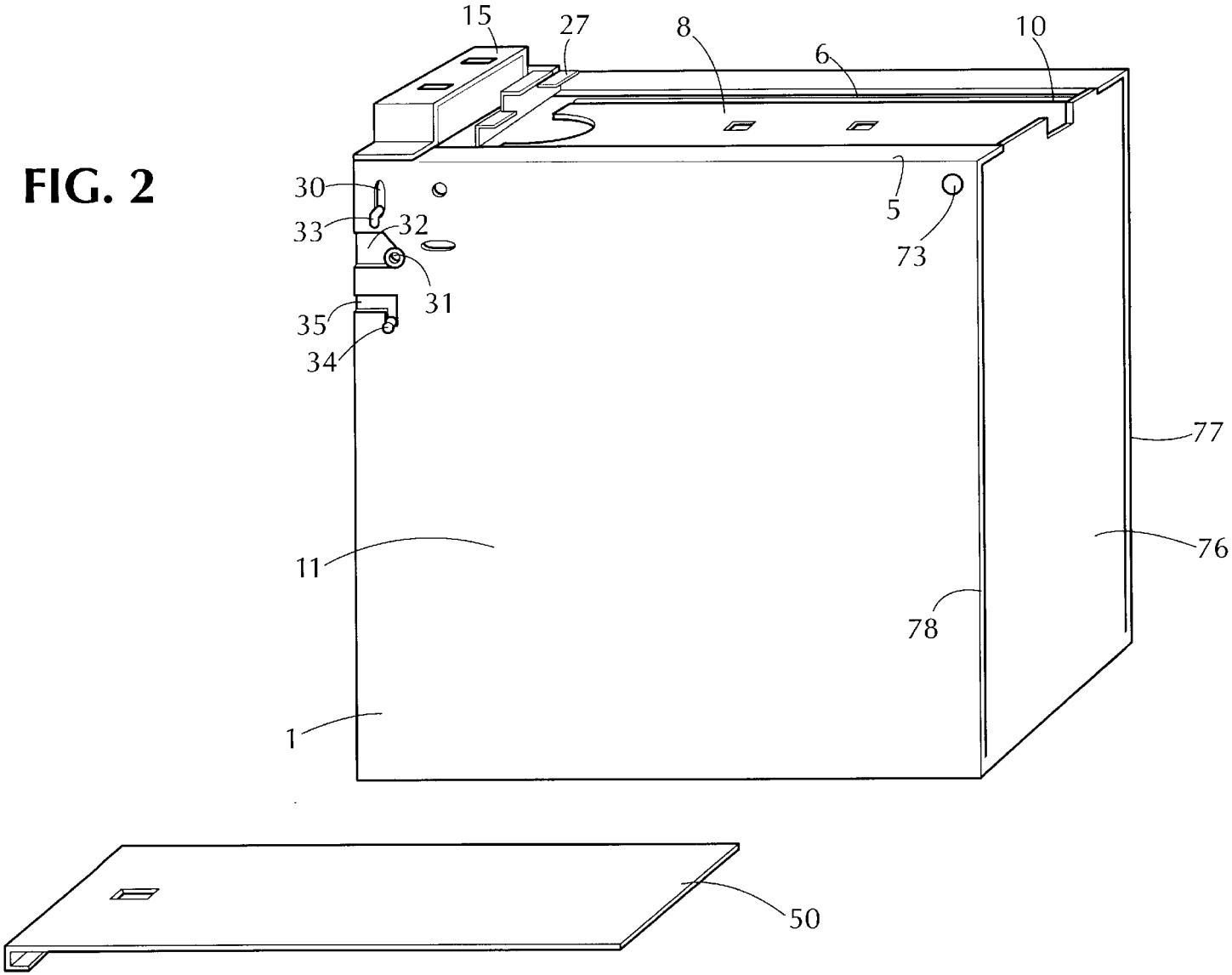
FIG. 2 illustrates the cassette's side, back and top.

FIG. 2 is a view of the cassette showing the side, top and back portions of the cassette 1. FIG. 2 shows a full view of the portion of the flipper 27 which sits above the slidepath 20 when the slideplate is not inserted. This view also shows the underplate 8 which does not extend over the entire length of the cassette but instead approximately extends over the length of the cassette from the back of the cassette to the point where the flipper is located in the standby position.

Figure 3:
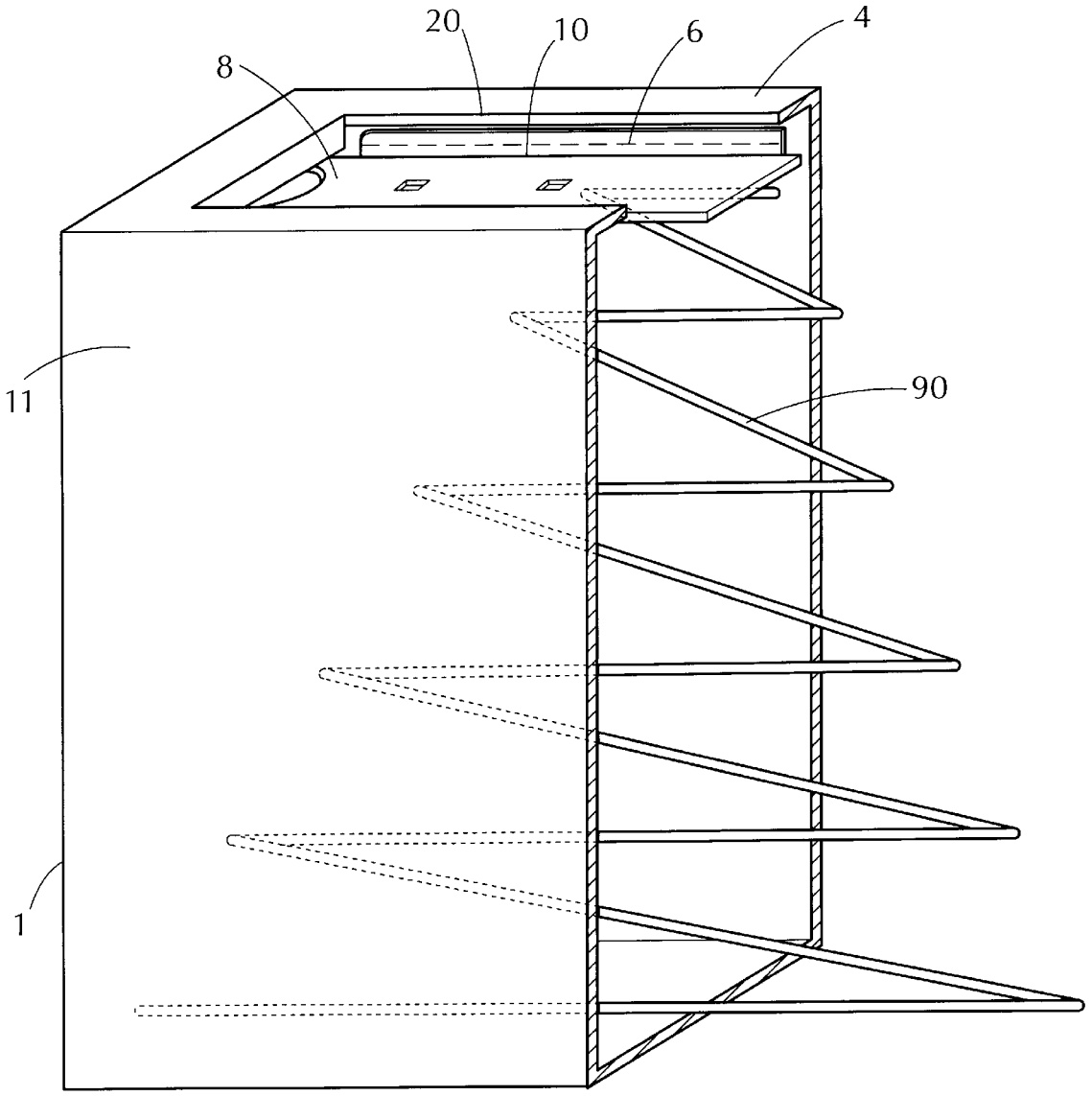
FIG. 3 is a cross-sectional view of the cassette showing the inner coil.

FIG. 3 illustrates a cross-sectional view of the cassette 1. This view shows that the moving rail 6 may be in the standby or first position wherein the bottom of the moving rail 6 is represented by the dotted line on moving rail 6 or the moving rail 6 may be in the offset or second position shown in this view.

This view also shows the inner coil 90 which is attached at its top to the bottom of the underplate 8. The inner coil 90 is retractable and as such its function is to press the bill stack firmly upwards so that the bill stack stacks neatly with each bill oriented directly on top of the bill below it. Thus, as each bill is pushed into the cassette chamber, the bill stack becomes one bill thicker and the inner coil 90 retracts slightly. In another embodiment of the cassette, the coil may be replaced by a retractable foam insert.

Figure 4A:
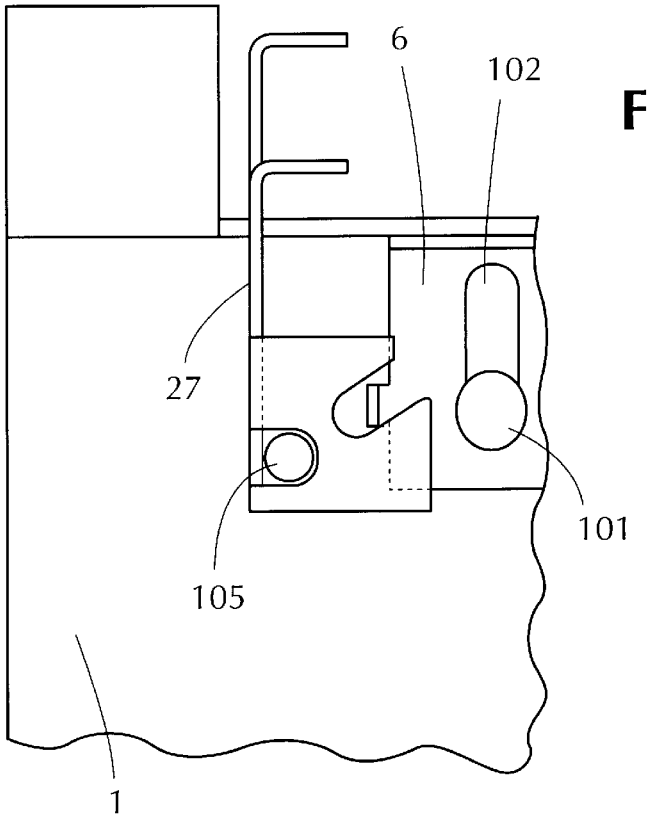
FIG. 4*a* and 4*b* are cut-away views showing the front portion of the moving rails.
Figure 4B:
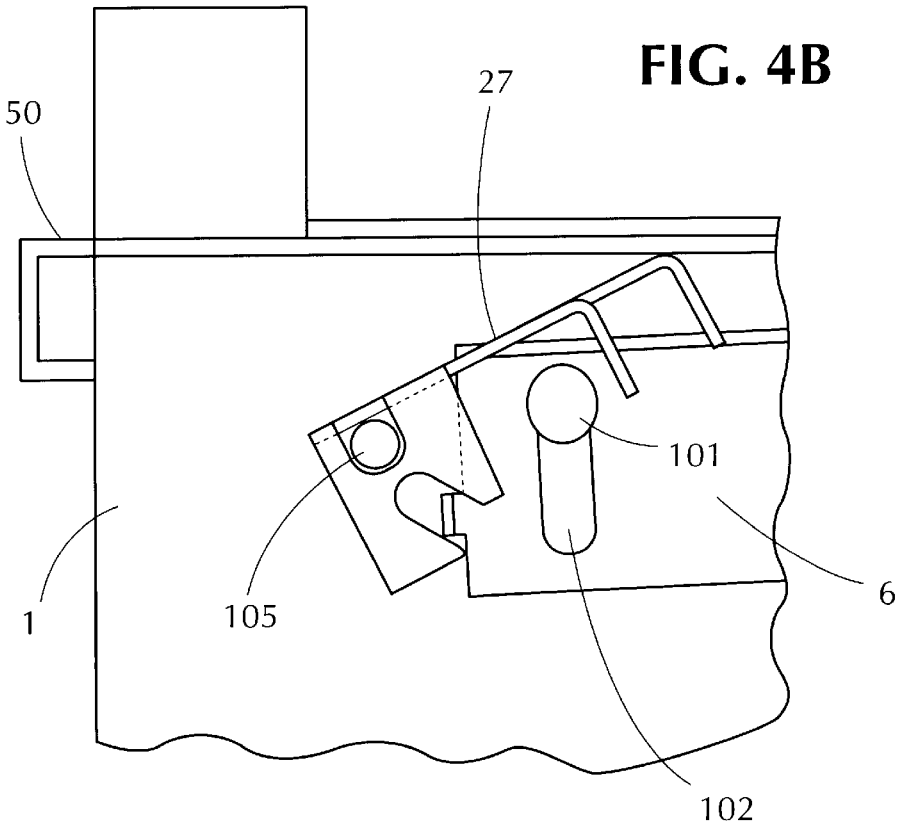

FIG. 4*a* and 4*b* illustrate a cut-away view of the front portion of movable rail 6 inside cassette 1 [in FIGS. 4*a*, 4*b*, 5*a* and 5*b*, the top of the cassette is to the left of the figures]. FIG. 4*a* shows movable rail 6 and flipper 27 in the standby or first position. In this position, the movable rail is snug up against the top of cassette 1, and the flipper 27 is oriented perpendicular to the top of the cassette. The movable rail 6 is movable at its front by virtue of a railslot 102 which slides on a railpin 101. The flipper 27 hinges on a flipper hinge 105. FIG. 4*b* shows movable rail 6 and flipper 27 in the offset or second position, when the slideplate 50 is fully inserted. In the offset position, the flipper 27 is flipped down by the slideplate 50 so that it creates an offset distance between the slideplate 50 and the movable rail 6.

Figure 5A:
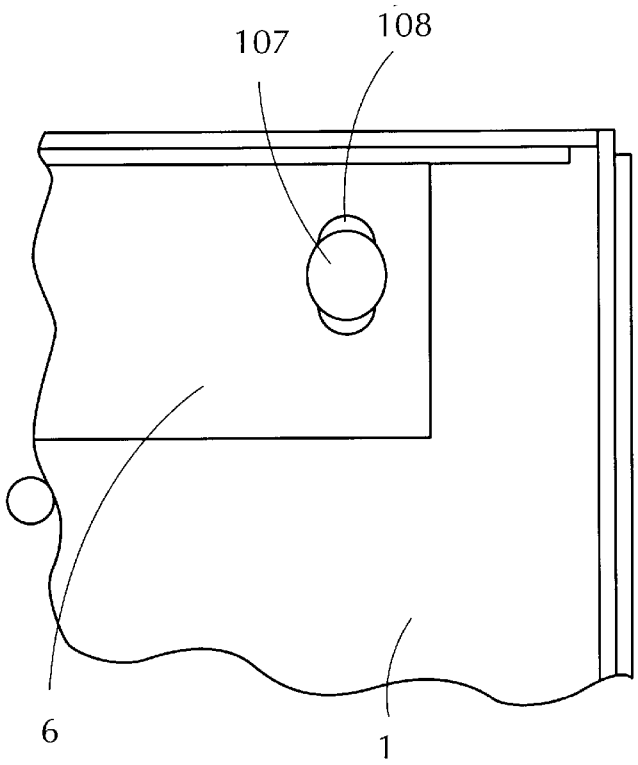
FIG. 5*a* and 5*b* are cut-away views showing the back portion of the moving rails.
Figure 5B:
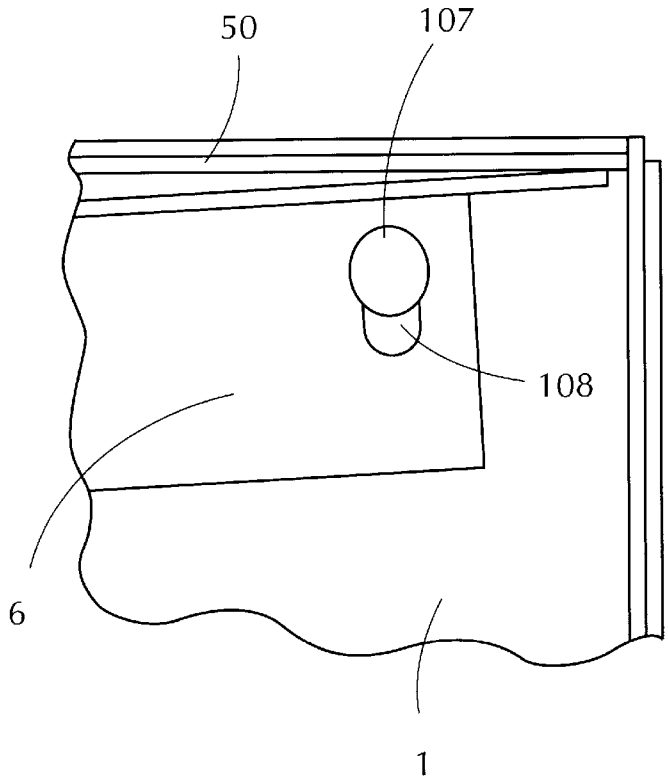

FIG. 5*a* and 5*b* illustrate a cut-away view of the back portion of movable rail 6 inside cassette 1. FIG. 5*a* shows movable rail 6 in the standby or first position. In this position, the movable rail is snug up against the top of cassette 1. The movable rail moves at its back by virtue of a railslot 108 which slides on a railpin 107. FIG. 5*b* shows movable rail 6 in the offset or second position, when the slideplate 50 is fully inserted.

Figure 6:
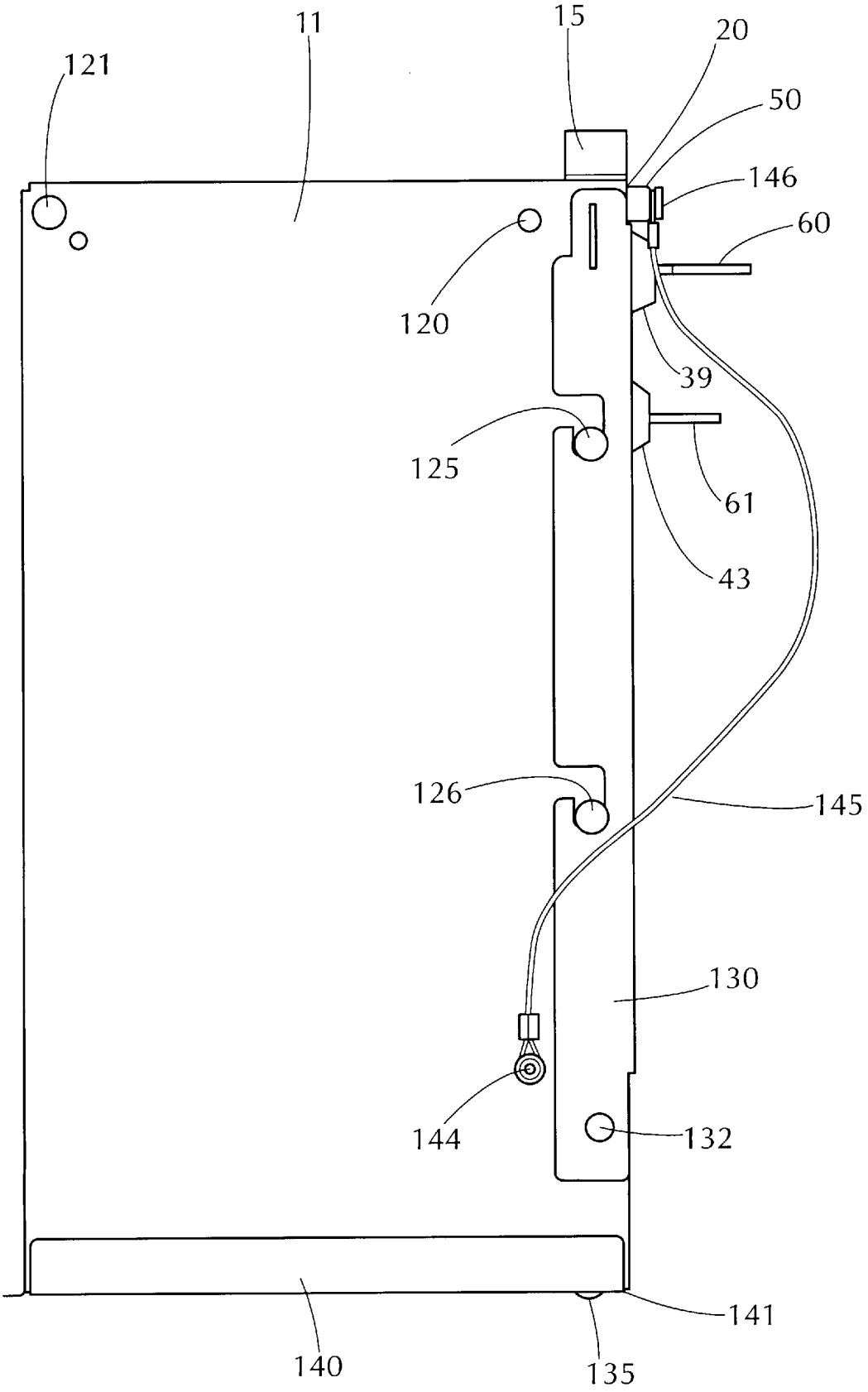
FIG. 6 is a side view of a second embodiment of the cassette.
Figure 7:
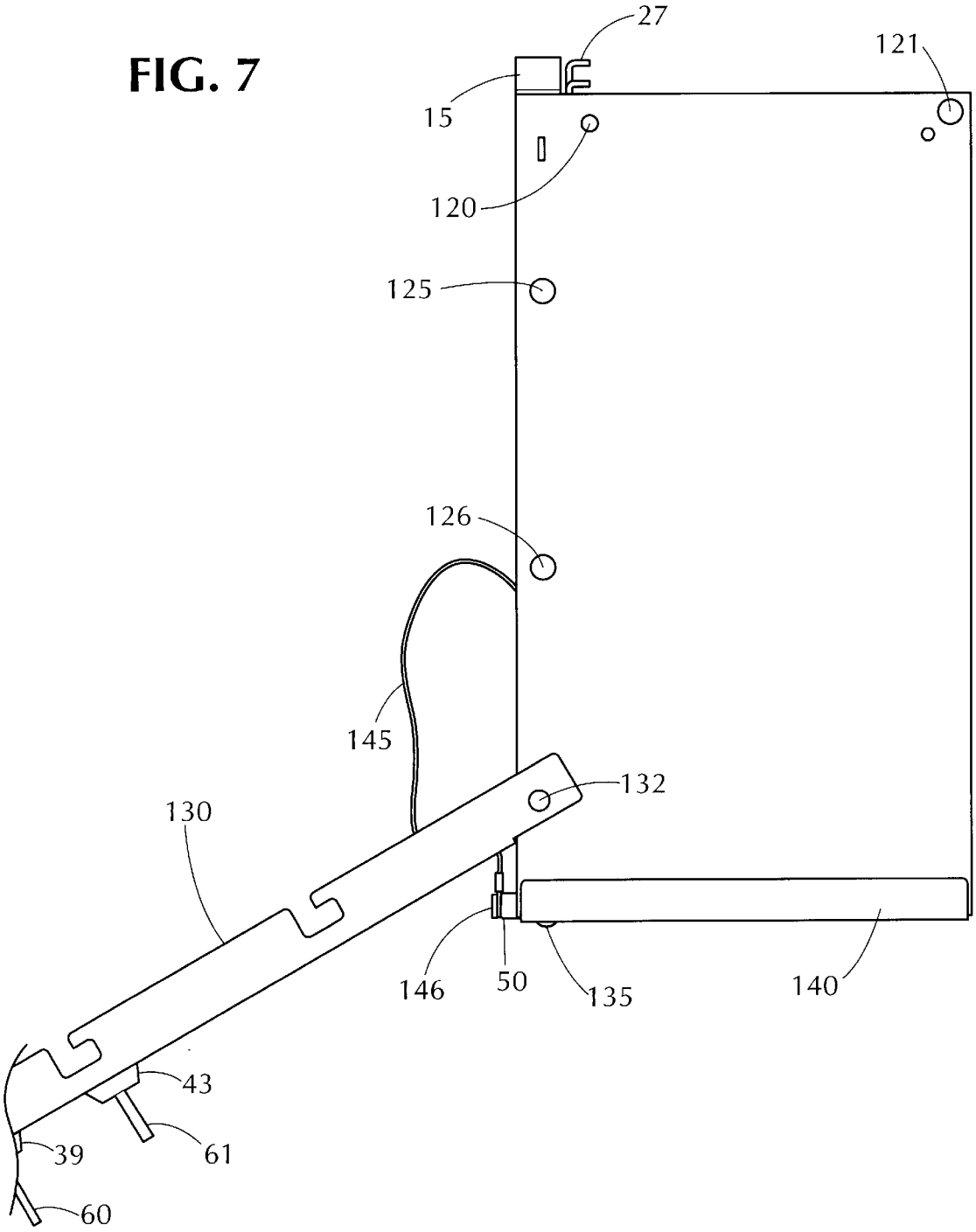
FIG. 7 is the other side view of the second embodiment.
Figure 8:
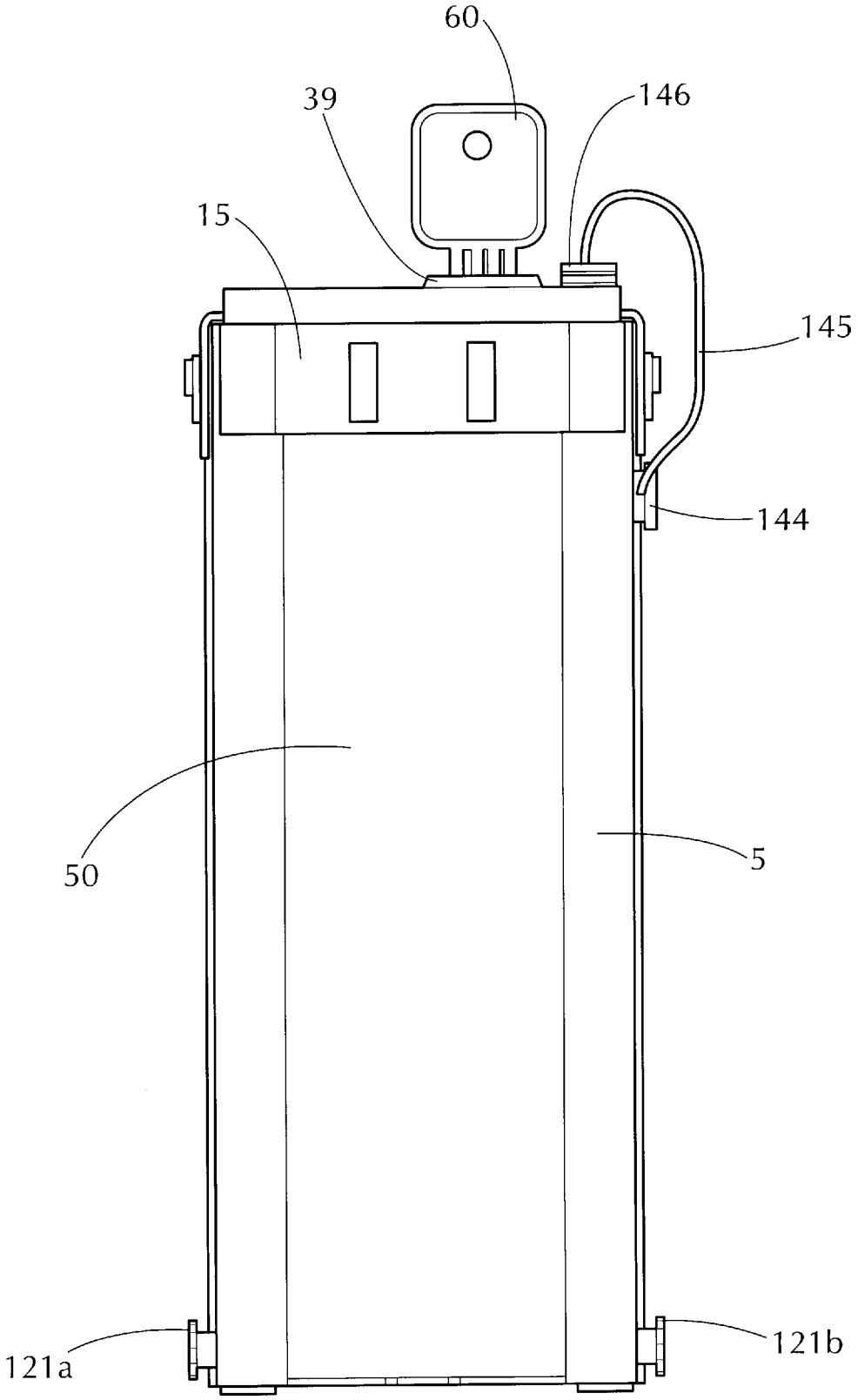
FIG. 8 is a top view of the second embodiment.

FIGS. 6–8 show a preferred embodiment of the cassette. FIG. 6 shows a sideview of this embodiment wherein the hatch 130 extends the entire height of the cassette. The hatch 130 is held in place to the cassette by hatch pins 125 and 126 which are held in place by grooved slots in the hatch 130. This embodiment is also outfitted with a slideplate 50 which is secured to the cassette housing 11 by a lanyard 145. The lanyard 145 is connected to the slideplate 50 by a pin 146 and the lanyard is secured to the cassette by a pin 144. When the cassette is in operation with the validator, the slideplate is stored in an auxiliary slideplate path 141 which is created by a gap between the bottom end of the cassette housing 11 and spacing plate 140. To disconnect the cassette from the validator, the service agent must unlock the first keylock 43 with key 61. This allows the service agent to push the slideplate 50 into the slideplate path 20 at the top of the cassette, thus activating the moving rails (unseen). When the slideplate 50 is fully inserted into the slideplate path 20, the cassette may be detached from the validator at the validator coupling 15.

To access the bill stack at a secure location, a clerk then unlocks second keylock 39 with key 61. Hatch 130 may then be swung away as shown in FIG. 7. Under this embodiment, the full length of the bill stack is easily accessed. Under this embodiment, secure holding pins 120 and 121 make attachment to the validator easier and also facilitate the easy removal of the cassette. These holding pins also aid in holding the cassette in place during operation.

FIG. 8 shows a top view of this embodiment with slideplate 50 inserted and secure latching pins 121*a* and 121*b*. It also demonstrates the lanyard 145 and pins 144 and 146.

The preferred materials for the housing 11 and all other apparatus is steel for durability and strength, and it is further preferred that the steel be coated with electroless or bright nickel. It is possible however that the apparatus may be made of other metals, alloys, plastic or other thermoplastic resins.

Although the invention has been described with regard to preferred embodiments, it is not intended that the preferred embodiments shall be a limitation on the scope of the invention.

What is claimed is:

1. A removable bill stacking cassette for use with and attachment to a currency validator equipped with a plunger for introducing bills into the bill stacking cassette's housing, comprising:

a) a bill stacking housing with an open end for receiving bills introduced into the housing chamber by the plunger;

b) a slideplate for enclosing the open end of the housing;

c) a locking means which allows the slideplate to cover the open end of the housing when the locking means is in an unlocked position;

d) an attaching means which allows the cassette to be removed from the currency validator when the slideplate is positioned to cover the open end of the chamber; and e) movable rails which 1) lie below the slideplate path such that the slideplate path is between the movable rails and open end of the housing; 2) lie above the billstack; and 3) move when the slideplate is inserted into the slideplate path so that the billstack is offset below the inserted slideplate.

2. The removable bill stacking cassette of claim 1, in which the locking means is a key lock.

3. The removable bill stacking cassette of claim 1, in which the bill stacking housing is equipped with a retractable device whereby the retractable device pushes the bill stack towards the open end of the housing.

4. The removable bill stacking cassette of claim 3, in which the retractable device is a coil.

5. The removable bill stacking cassette of claim 3, in which the retractable device is a foam insert.

6. The removable bill stacking cassette of claim 1, in which the cassette housing is made of steel.

7. A removable bill stacking cassette for use with and attachment to a currency validator equipped with a plunger for introducing bills into the bill stacking cassette's housing, comprising:

a) a bill stacking housing with an open end for receiving bills introduced into the housing chamber by the plunger;

b) a slideplate for enclosing the open end of the housing;

c) a first locking means which allows the slideplate to cover the open end of the housing;

d) a second locking means which allows access to the cassette housing chamber;

e) an attaching means which allows the cassette to be removed from the currency validator when the slideplate is positioned to cover the open end of the chamber; and f) movable rails inside the housing which (1) provide a slideplate path for the slideplate between the movable rails and the open end of the housing; and (2) move when the slideplate is inserted into the slideplate path so that the bill stack in the housing chamber is offset from the slideplate path.

8. The removable bill stacking cassette of claim 7, in which the first locking means is a key lock.

9. The removable bill stacking cassette of claim 7, in which the second locking means is a key lock.

10. The removable bill stacking cassette of claim 7 in which the cassette housing is made of steel.

* * * * *